United States Patent [19]

Eike

[11] Patent Number: 4,536,999

[45] Date of Patent: Aug. 27, 1985

[54] SHIP/OFFSHORE WINDOW FOR PERMANENT MOUNTING IN THE EXTERNAL STEEL BULKHEAD OF A WALL

[75] Inventor: Einar Eike, Tvedestrand, Norway

[73] Assignee: Golar Metall, Hilco Industries A/S, Tvedestrand, Norway

[21] Appl. No.: 497,848

[22] Filed: May 25, 1983

[30] Foreign Application Priority Data

Jun. 4, 1982 [NO] Norway ..... 821873

[51] Int. Cl.[3] ..... B63B 19/00; E06B 3/00

[52] U.S. Cl. ..... 52/208; 49/463; 52/213; 114/177

[58] Field of Search ..... 52/208, 213, 217, 304, 52/397, 488, 788, 791, 803, 804, 202, 509, 512, 474, 476, 764, 769; 49/463; 114/177, 173; 244/129.3

[56] References Cited

U.S. PATENT DOCUMENTS 2,784,926 3/1957 Bonza et al. ..... 244/129.3

3,382,630 5/1968 Chivers ..... 52/208

*Primary Examiner*—J. Karl Bell

*Attorney, Agent, or Firm*—Lester Horwitz

[57] ABSTRACT

A ship/offshore window for permanent mounting in the external steel bulkhead of a wall, for example by welding, comprising a window frame, preferably of steel, for pressure-proof and airtight retention of a plurality of glass members having different desired properties for rendering the window unit pressure/explosion-proof, for example, fireproof, soundproof and light/heat reflective, in various degrees and both separately and in various combinations. The desired glass members are assembled in a hermetically sealed package of glass members wherein the marginal edges of the pressure-proof glass members project beyond the marginal edges of the other glass members. Said two sets of marginal edges are surrounded by a similarly offset (in cross section) protective/retainer frame, the projecting portion of said frame and the projecting edges of the pressure-proof glass members being intended to be retained tightly but detachably between the inside surface of the window frame and inwardly projecting fastening means secured to the window frame. The fastening means comprise inwardly projecting screw bolts on the inside of the frame with clamping disks having one or more holes which are aligned with said screw bolts and which are intended to cooperate with the offset portion of the retainer frame, as well as nuts for tightening the clamping disks against said offset frame portion.

2 Claims, 2 Drawing Figures

SHIP/OFFSHORE WINDOW FOR PERMANENT MOUNTING IN THE EXTERNAL STEEL BULKHEAD OF A WALL

The present invention relates to a ship/offshore window for permanent mounting in external steel bulkhead of a wall, for example by welding, the window comprising a window frame, preferably of steel, for pressure-proof and airtight retention of a number of glass members having different desirable properties for rendering the glazing unit pressure/explosion-proof as well as, e.g., fireproof, light/heat reflective and soundproof, in different degrees and both separately and in various combinations.

This type of window in the prior art consists of two or more separate sheets of glass which are mounted in a steel/aluminium frame, the window being given special properties through different combinations of the types of glass members recited above.

In order to alter the properties possessed by a window of this known type, it is necessary to replace the entire window frame, not just the glass members that have been fastened in the frame. This is an elaborate operation, as the window frame must be detached from the steel bulkhead before a new steel frame containing the new combination of glass members can be welded in place.

The object of the present invention is to provide a window construction—an offshore/ship window—in which the frame itself is still intended to be mounted by welding it to the external steel bulkhead of a wall, but in which the combination of glass members consisting of at least two glass members can easily be mounted in/-removed from the steel frame, permitting easy replacement of one combination of glass members by another combination of glass members having different properties.

This is obtained in accordance with the invention by means of the characterizing feature recited in the appurtenant claim 1 and in the succeeding dependent claims.

According to the invention, a number of glass members of desired types are assembled in a hermetically sealed package of glass members having at least one pressure-proof glass members which projects beyond the edges of the other glass members in the unit, said projecting portion permitting the glazing unit to be secured to the steel window frame. The marginal edges of the glazing unit are surrounded by a protective retainer frame of similar offset configuration which is brought into contact with the fastening means provided on the window frame. The fastening means are preferably screw bolts projecting inwardly from the steel frame, and the screw bolts are provided with clamping disks which cooperate with the projecting edge of the retainer frame and are tightened against the latter by means of nuts.

In this manner, different types of glazing units of different total thicknesses can be placed in the window frame and secured in position by means of the screw bolts and clamping disks.

Figure 1:
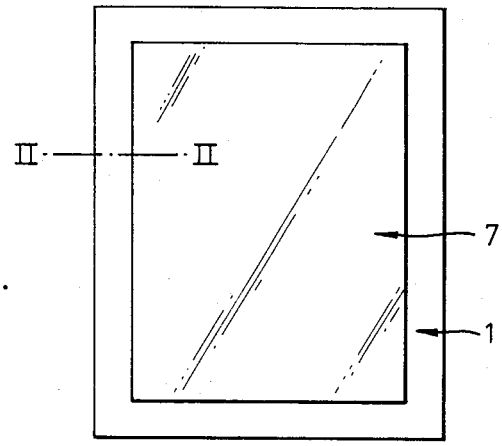
Figure 2:
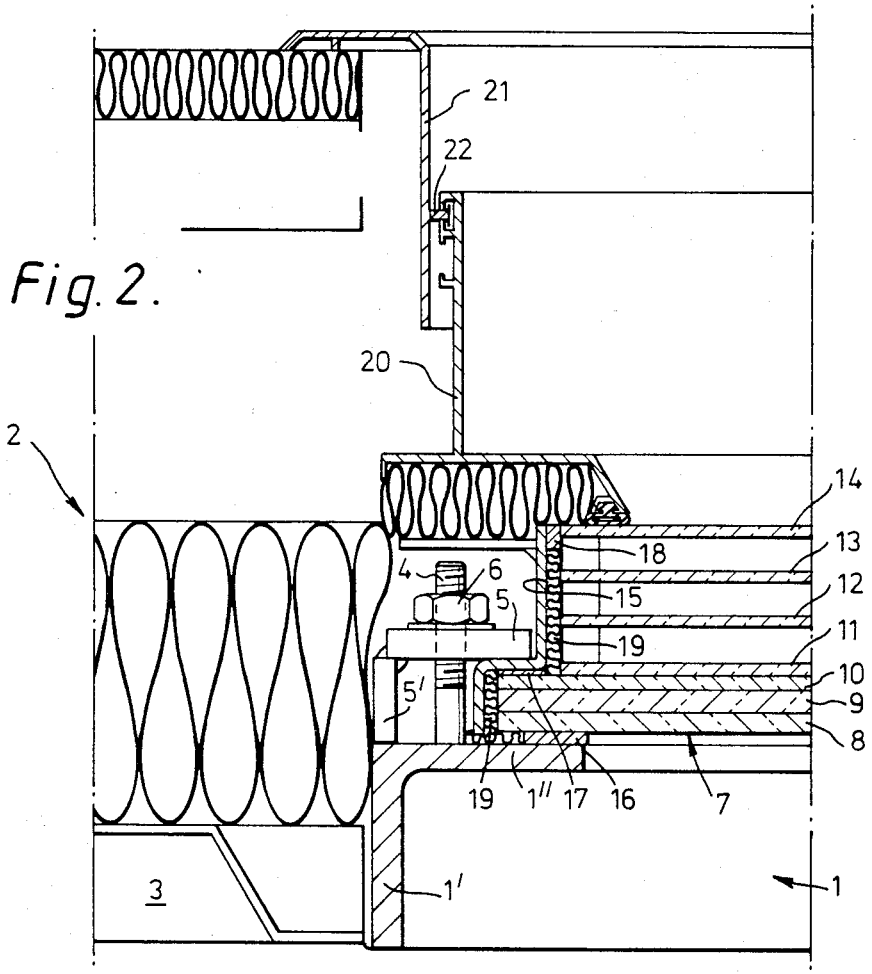

An exemplary embodiment of the invention will be described in greater detail in the following with reference to the accompanying drawings, wherein FIG. 1 shows the window construction as seen from the outside, and FIG. 2 shows the window frame and glazing unit in cross section, along the line II—II in FIG. 1.

FIG. 1 shows a ship/offshore window as seen from the outside. As may be seen in the cross-sectional drawing in FIG. 2, the window consists of a right-angled steel frame 1 fastened to the external steel bulkhead 3 of a wall 2, e.g., by welding. The steel frame is provided with projecting screw bolts 4 with clamping disks 5 and nuts 6 along the periphery of the frame. A glazing unit 7 comprises three pressure/explosion-proof glass members 8,9,10 and four glass members 11,12,13,14 which for instance provide fireproofing, light/heat reflection and soundproofing. Said glass members are hermetically sealed together in a manner known per se, and the marginal edges of the glazing unit 7 are surrounded by a retainer/protective frame 15 of an offset configuration adapted to the offset margin of the glazing unit 7, wherein the edges of the pressure-proof members 8,9,10 project beyond the edges of the other glass members 11,12,13,14. The projecting edge portions of the glazing unit 7 are retained by the clamping disk 5 and the screw bolt 4 on the steel frame 1 when the glazing unit is placed against the inside of the steel frame 1. The clamping disk 5 is pressed against the projecting edges by means of the nut 6. To obtain a good clamping effect of the clamping disk 5 against the glazing unit 7, a support 5' is provided at the outer edge of the clamping disk which supports the clamping disk 5 against the steel frame 1, such that when the nut 6 is tightened, the clamping disk 5 will exert a clamping effect on the projecting, offset edges with a pivot point about the point of contact of the support 5' against the steel frame 1.

Weatherstripping 16 as known per se is inserted between the glazing unit 7 and the steel frame 1, and weatherstripping 17, 18 and insulation material 19 are also inserted between the retainer frame 15 and the glazing unit 7. Between the glass members 11, 12, 13 and 14, a transparent chemical substance may be inserted which when subjected to heat will burn or harden to form fire-insulating bodies or a coating between the glass members.

To replace one glazing unit 7 with another unit having different characteristics, for example having a lesser or greater number of glass members 11,12,13,14, the original glazing unit 7 is easily released from the steel frame 1 by loosening the fastening means 4,5,6. The new glazing unit 7 is then placed in the frame and retained by retightening the fastening members 4,5,6, the offset edge formed by the pressure/explosion-proof glass members 8,9,10 being of approximately the same thickness in all cases. If the thickness of these members is altered, perhaps by providing two glass members instead of three in this portion of the glazing unit, the clamping disk 5 can be secured against the offset edge of the glazing unit by further tightening the nut 6. If the clamping disk 5 is provided with the above-mentioned support 5', a new set of clamping disks 5 with shorter supports 5' can be used for securing the glazing unit. For adapting the window construction to walls 2 of different thicknesses, the window can be provided as known per se with a telescopic frame assembly comprising two frames 20,21 which slide in relation to each other and have an intermediate gasket 22 therebetween. The inner frame 20 is in contact with the inside surface of the glazing unit 7 while the outer frame 21 has a projection which lies against the inside surface of the wall 2.

Having described my invention, I claim:

1. A ship/offshore window for permanent mounting in the external steel bulkhead of a wall, for example by welding, comprising a frame, preferably of steel, for pressure/proof and airtight retention of a number of glass members assembled in a package and having different desired properties for rendering the window pressureexplosion-proof and optionally, fireproof, light-/heat reflective and soundproof, in different degrees and both separately and in various combinations, wherein the marginal edges of the pressure-proof glass member(s) project beyond the edges of the other glass members, said marginal edges being intended to be tightly but detachably retained between the window frame and releasable fastening means in engagement cooperating with the window frame, the improvement which comprises that the desired types of glass members are assembled in a hermetically sealed package unit of glass members, where said projecting margins of the pressure-proof glass members and the retracted margins of the other glass members are surrounded by a similarly offset (in cross section) protective/retainer frame, the projecting portion of said frame and the projecting margins of said pressure-proof glass member(s) being intended to be tightly but detachably retained between the inside surface of the window frame and said releasable fastening means which are secured to the window frame and are inwardly-projecting.

2. A ship/offshore window according to claim 1, characterized in that the fastening means comprise inwardly projecting screw bolts on the inside of the frame with clamping disks having one or several holes which are in alignment with said screw bolts and which are intended to cooperate with the offset portion of the retainer frame, as well as nuts for clamping the clamping disks against said offset portion.

* * * * *

UNITED STATES PATENT AND TRADEMARK OFFICE

CERTIFICATE OF CORRECTION

PATENT NO. : 4,536,999

DATED : August 27, 1985

INVENTOR(S) : Einar EIKE

It is certified that error appears in the above-identified patent and that said Letters Patent is hereby corrected as shown below:

First page, assignment data, delete "Industries" and replace therefor -- Industrier --

Signed and Sealed this

*Fifteenth* Day of *April 1986*

[SEAL]

*Attest:*

DONALD J. QUIGG

*Attesting Officer*

*Commissioner of Patents and Trademarks*